United States Patent [19]

Tanaka

[11] Patent Number: 4,534,325

[45] Date of Patent: Aug. 13, 1985

[54] CAM SHAFT HOLDING SYSTEM FOR INTERNAL COMBUSTION ENGINE

[75] Inventor: Fusatoshi Tanaka, Hiroshima, Japan

[73] Assignee: Mazda Motor Corporation, Japan

[21] Appl. No.: 633,441

[22] Filed: Jul. 23, 1984

[30] Foreign Application Priority Data

Jul. 27, 1983 [JP] Japan ..... 58-117681[U]

[51] Int. Cl.[3] ..... F01L 1/02

[52] U.S. Cl. ..... 123/90.27; 123/90.6; 123/195 H; 384/432

[58] Field of Search ..... 123/193 H, 90.27, 90.6, 123/195 A; 248/916; 384/432, 433

[56] References Cited

U.S. PATENT DOCUMENTS 3,144,013 8/1964 Peras ..... 123/90.27
3,289,658 12/1966 Surovek ..... 123/90.6

FOREIGN PATENT DOCUMENTS 643 1/1978 Japan .
2409 1/1982 Japan ..... 123/90.27
28416 6/1983 Japan .

*Primary Examiner*—Ira S. Lazarus
*Assistant Examiner*—R. S. Bailey
*Attorney, Agent, or Firm*—Murray, Whisenhunt and Ferguson

[57] ABSTRACT

In a cam shaft holding system for an internal combustion engine, a cylinder head is secured to a cylinder block by cylinder head mounting bolts positioned between adjacent cylinders. An intake cam shaft and an exhaust cam shaft are extended at positions outside the cylinder head mounting bolts along the row of the cylinders. Cam shaft holding members are positioned between the cylinders for rotatably supporting the cam shafts on the cylinder head. Each cam shaft holding member intersects perpendicularly with each cam shaft and has bolting portions at its end portions such that at least the end portion on the cylinder head mounting bolt side is provided with two bolting portions. The bolting portions define an aperture therebetween for avoiding interference with each cylinder head mounting bolt.

5 Claims, 3 Drawing Figures

CAM SHAFT HOLDING SYSTEM FOR INTERNAL COMBUSTION ENGINE

BACKGROUND OF THE INVENTION

1. Field of the Invention

This invention relates to a cam shaft holding system for holding cam shafts on a cylinder head in a multicylinder internal combustion engine wherein a plurality of valves consisting of at least one intake valve and at least one exhaust valve are positioned for each cylinder and opened and closed by cams secured to intake and exhaust cam shafts.

2. Description of the Prior Art

In internal combustion engines, in order to minimize size and improve performance, it is desired to minimize the included angle between intake valves and exhaust valves. This is because, when the included angle between the intake valves and the exhaust valves is small, it becomes possible to decrease the volume of the combustion chamber and, therefore, it becomes possible to increase the compression ratio. Also, it becomes possible to minimize the surface area of the combustion chamber. As a result, it becomes possible to improve the combustion efficiency.

In order to minimize the included angle between the intake valves and the exhaust valves, it is necessary to decrease the distance between an intake cam shaft for opening and closing the intake valves and an exhaust cam shaft for opening and closing the exhaust valves. However, when the distance between the intake cam shaft and the exhaust cam shaft is simply decreased, cam shaft holding members for holding the intake cam shaft and the exhaust cam shaft on the cylinder head become close to and interfere with cylinder head mounting bolts for mounting the cylinder head on a cylinder block.

In order to eliminate the above-mentioned problem, it has been proposed, for example in Japanese Utility Model Publication No. 53(1978)-643, to position one cam shaft bearing between the intake valve driving cams for each cylinder and another between the exhaust valve driving cams for each cylinder.

FIG. 3 is a plan view showing the conventional cam shaft holding system for a multivalve internal combustion engine. In this system, an intake cam shaft a and an exhaust cam shaft b are positioned above the upper surfaces of cylinder head mounting bolts c, c, . . . . . Between cams a1 and a2 of the intake cam shaft a and between cams b1 and b2 of the exhaust cam shaft b are positioned cam shaft bearings d, d for holding the intake cam shaft a and the exhaust cam shaft b on the cylinder head.

In the aforesaid cam shaft holding system, it is possible to prevent the cam shaft bearings d, d which hold the intake cam shaft aand the exhaust cam shaft b on the cylinder head from interfering with the cylinder head mounting bolts c, c, . . . . However, since the cam shaft bearings d, d are positioned in very narrow spaces between the adjacent intake cams a1 and a2 and between the adjacent exhaust cams b1 and b2, the widths of the cam shaft bearings d, d must be small. Therefore, the widths of the cam shaft holding portions of the cam shaft bearings d, d must also be small. This is disadvantageous from the viewpoint of engine performance, i.e. wear resistance of the cam shaft holding portions of the cam shaft bearings d, d, or the like.

Specifically, when the intake cam shaft a and the exhaust cam shaft b are rotated, a considerably high surface pressure or the like is exerted thereby on the cam shaft holding portions of the cam shaft bearings d, d. Therefore, in order to prevent the cam shaft holding portions of the cam shaft bearings d, d from breaking, it is necessary to adjust the spring constants, the spring member sizes and the spring coil diameters of the valve springs used in the intake valves and the exhaust valves which are operated by the intake cam shaft a and the exhaust cam shaft b. However, when the widths of the cam shaft holding portions of the cam shaft bearings d, d are small, the spring constants, the spring member sizes and the spring coil diameters of the valve springs must be decreased to prevent the cam shaft holding portions of the cam shaft bearings d, d from breaking. In this case, the valve springs become unable to follow high speed operation of the engine. Further, when the spring member sizes and the spring coil diameters of the valve springs are small, stresses arising in the members of the valve springs increase excessively, and it becomes necessary to replace the valve springs frequently.

Further, it has been proposed in Japanese Patent Publication No. 58(1983)-28416 to position a first cam shaft holding member and a second cam shaft holding member on a cylinder head and secure them to each other by use of bolts positioned on cylinder head mounting bolts coaxially therewith. In this system, through no problem arises with regard to the sizes of the cam shaft holding portions, the configuration of the cam shaft holding system becomes complicated. Also, when work concerning the cylinder head mounting bolts is conducted, it becomes necessary to remove other members in advance.

SUMMARY OF THE INVENTION

The primary object of the present invention is to provide a cam shaft holding system for an internal combustion engine wherein cam shafts can be positioned close to the center of the engine so that widths of the cam shaft holding portions of cam shaft holding members are not limited.

Another object of the present invention is to provide a cam shaft holding system for an internal combustion engine, which has a simple configuration and improves work efficiency concerning the cylinder head mounting bolts.

The present invention provides a cam shaft holding system for an internal combustion engine in which a plurality of valves consisting of at least one intake valve and at least one exhaust valve are positioned for each cylinder of the multicylinder engine and driven by cams secured to two cam shafts, wherein the improvement comprises:

(i) securing a cylinder head to a cylinder block by cylinder head mounting bolts positioned between adjacent cylinders, (ii) extending said cam shafts adjacent to said cylinder head mounting bolts at positions outside said cylinder head mounting bolts and in the direction of the row of said cylinders, (iii) positioning cam shaft holding members between said adjacent cylinders for rotatably supporting said cam shafts on said cylinder head, (iv) each of said cam shaft holding members extending in the direction perpendicularly intersecting the axial direction of each cam shaft and having bolting portions at its end portions, (v) at least the end portion on the cylinder head mounting bolt side of each of said cam shaft holding members for rotatably supporting said cam shafts for driving a plurality of said valves for each cylinder being provided with a single bolting portion on either side of each cylinder head mounting bolt on the axial direction of each cam shaft.

In the cam shaft holding system for an internal combustion engine in accordance with the present invention, since holding of the cam shafts by the cam shaft holding members is effected at positions between the cylinders, the spaces for positioning the cam shaft holding members are not limited when the cam shafts are positioned close to the center of the engine. Therefore, it is possible to use cam shaft holding members having sufficiently wide cam shaft holding portions. Further, it is possible to prevent the cam shaft holding members from interfering with the cylinder head mounting bolts. Also, it is possible to improve the work efficiency with regard to the cylinder head mounting bolts.

PRIOR LITERATURE

Japanese Utility Model Publication No. 53(1978)-643 discloses a cam shaft holding system for a multivalve internal combustion engine wherein a set of intake valves 6, 6 or a set of exhaust valves 7, 7 at one cylinder are opened and closed by a set of cams 9, 9 or a set of cams 10, 10 adjacent to a cam shaft 4 or 5, and a cam shaft bearing 22 is positioned between a set of the cams 9, 9 or a set of the cams 10, 10, thereby holding the cam shaft 4 or 5.

Japanese Patent Publication No. 58(1983)-28416 discloses an engine member fixing system comprising a cylinder head 4 secured to a cylinder block 1 by a cylinder head mounting bolt 6, a first member 15 and a second member 16 or 17 for supporting a shaft which are secured together to the cylinder head 4, and a second bolt 20 and a nut 21 positioned coaxially with the cylinder head mounting bolt 6 for joining the first member 15 with the second member 16 or 17. The upper portion of the inner circumference of the nut 21 is provided with a square groove 23 having a size larger than the inner diameter of the threaded portion of the nut 21 for engagement with the second bolt 20. A square portion 24 is formed at the outer circumference of the nut 21 and fitted into a square groove 26 positioned in a head portion 25 of the cylinder head mounting bolt 6.

DESCRIPTION OF THE PREFERRED EMBODIMENTS

The present invention will hereinbelow be described in further detail with reference to the accompanying drawings.

Figure 1:
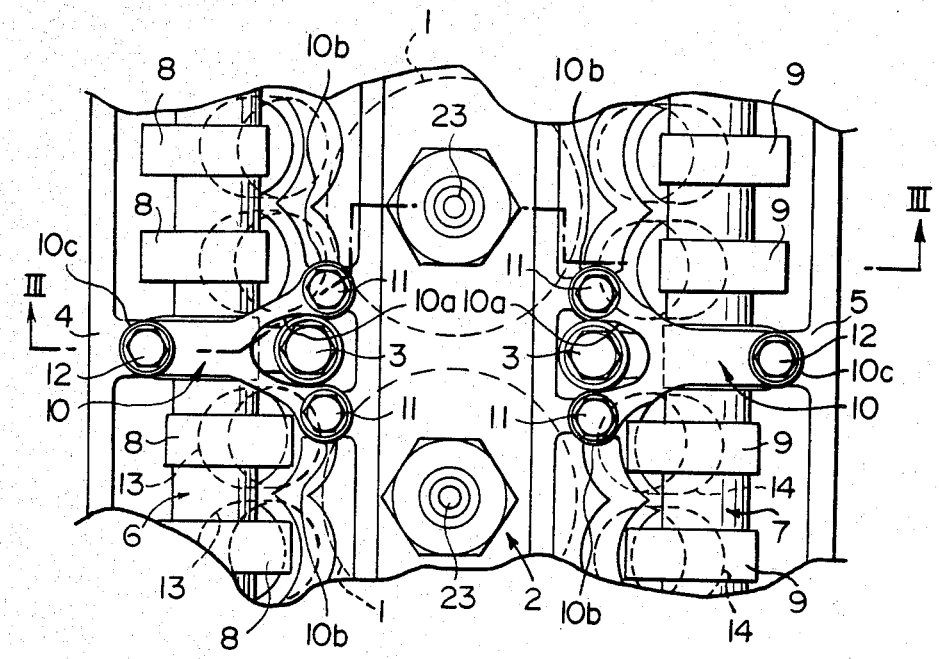
FIG. 1 is a plan view showing an embodiment of the cam shaft holding system for an internal combustion engine in accordance with the present invention.
Figure 2:
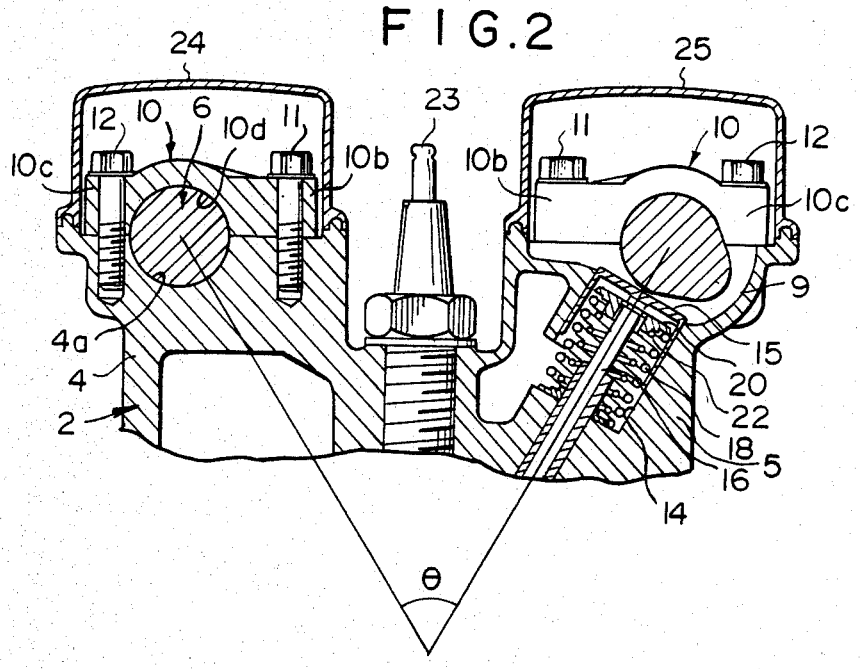
FIG. 2 is a vertical sectional view taken along the line III—III of FIG. 1.

Referring to FIGS. 1 and 2, cylinders 1, 1 are positioned in a cylinder block (not shown), and a cylinder head 2 is secured to the upper surface of the cylinder block by cylinder head mounting bolts 3, 3. A left seat section 4 having a semicircular groove 4*a* for supporting the journal of an exhaust cam shaft 6 and a right seat section 5 having a similar groove are positioned at the upper portion of the cylinder head 2 integrally therewith at the center between the cylinders 1, 1.

The exhaust cam shaft 6 is supported on the journal supporting groove 4*a* of the left seat section 4, and an intake cam shaft 7 is supported on the journal supporting groove of the right seat section 5. On the exhaust cam shaft 6 and the intake cam shaft 7 are integrally formed exhaust cams 8, 8 and intake cams 9, 9 for each cylinder.

The exhaust cam shaft 6 and the intake cam shaft 7 respectively supported on the left seat section 4 and the right seat section 5 are held by cam shaft holding members 10, 10 on the left seat section 4 and the right seat section 5, i.e. on the cylinder head 2.

The cam shaft holding members 10, 10 are Y-shaped as viewed from above, and positioned in the direction normal to the axial direction of the exhaust cam shaft 6. Each cam shaft holding member 10 is provided at the inner end portion with an approximately U-shaped aperture 10*a* for avoiding interference with each cylinder head mounting bolt 3. On the opposite sides of the aperture 10*a*, the cam shaft holding member 10 has bolting portions 10*b*, 10*b*. Further, the cam shaft holding member 10 is provided at the outer end portion with a single bolting portion 10*c*. Also, the bottom surface of the cam shaft holding member 10 is provided with a semicircular cam shaft holding portion 10*d* for fitting on the upper half of the exhaust cam shaft 6.

As shown in FIGS. 1 and 2, holding of the exhaust cam shaft 6 on the left seat section 4 by the cam shaft holding member 10 is effected by securing the bolting portions 10*b*, 10*b* at the inner end portion of the cam shaft holding member 10 to the inner side end portion of the left seat section 4 by bolts 11, 11, and securing the bolting portion 10*c* at the outer end portion of the cam shaft holding member 10 to the outer side end portion of the left seat section 4 by a bolt 12. In this manner, the exhaust cam shaft 6 is rotatably held between the cam shaft holding portion 10*d* of the cam shaft holding member 10 and the journal supporting groove 4*a* of the left seat section 4.

The intake cam shaft 7 is held in the same manner by use of a cam shaft holding member 10 identical with that for the exhaust cam shaft 6.

The cylinder head 2 having the exhaust cam shaft 6 and the intake cam shaft 7 held as described above is secured to the upper surface of the cylinder block by the cylinder head mounting bolts 3, 3 inserted from above the apertures 10*a*, 10*a* of the cam shaft holding members 10, 10.

Exhaust apertures 13, 13 and intake apertures 14, 14 are perforated through the cylinder head 2 so that they are positioned just below the exhaust cams 8, 8 and intake cams 9, 9. An intake valve lifter 15 is positioned for vertical sliding in the upper portion of each of the intake apertures 14, 14. An intake valve stem 16 is positioned to contact the bottom surface of the upper plate of the intake valve lifter 15.

An intake valve spring 18 is positioned for urging the intake valve lifter 15 towards each intake cam 9 when the intake cam 9 is rotated to push down the intake valve lifter 15. Also, a retainer 20 is positioned for retaining the upper side of the intake valve spring 18, and a cotter 22 is positioned for securing the intake retainer 20 to the intake valve stem 16.

The reference numeral 23 designates the ignition plug, and the reference numeral 24 designates the head cover for covering the section on the side of the exhaust cam shaft 6. The reference numeral 25 denotes the head cover for covering the section on the side of the intake cam shaft 7.

Figure 3:
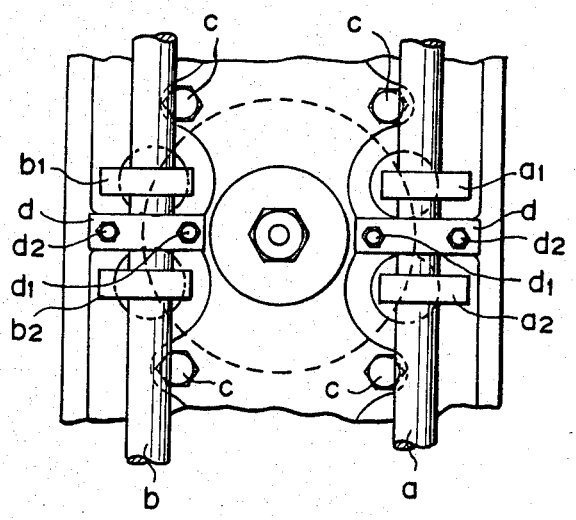
FIG. 3 PRIOR ART
FIG. 3 is a plan view showing the conventional cam shaft holding system for a multivalve internal combustion engine.

In this embodiment, the exhaust cam shaft 6 and the intake cam shaft 7 are held on the cylinder head 2 by the cam shaft holding members 10, 10 which are positioned in the direction perpendicularly intersecting the axial directions of the exhaust cam shaft 6 and the intake cam shaft 7 and which are respectively provided at the inner end portions with bolting portions 10*b*, 10*b* positioned with each of the cylinder head mounting bolts 3, 3 intervening therebetween, and provided at the outer end portions with the bolting portion 10*c*. Since the holding of the exhaust cam shaft 6 and the intake cam shaft 7 by the cam shaft holding members 10, 10 is effected at the positions between the cylinders 1, 1, the spaces for positioning the cam shaft holding members 10, 10 are not limited as in the case of the conventional cam shaft holding system. Therefore, it is possible to hold the exhaust cam shaft 6 and the intake cam shaft 7 by use of cam shaft holding members 10, 10 having a sufficiently wide cam shaft holding portion 10*d*. Accordingly, it is possible to eliminate adverse effect on the performance of the engine, which arises when the exhaust cam shaft 6 and the intake cam shaft 7 are held by the cam shaft bearings d, d having narrow cam shaft holding portions as shown in FIG. 3.

Also, since the cam shaft holding members 10, 10 of the cam shaft holding system in accordance with the present invention are provided with the apertures 10*a*, 10*a* for avoiding interference with the cylinder head mounting bolts 3, 3, the cam shaft holding members 10, 10 do not interfere with the cylinder head mounting bolts 3, 3 when the exhaust cam shaft 6 and the intake cam shaft 7 are positioned close to the mounting positions of the cylinder head mounting bolts 3, 3. Accordingly, it becomes possible to minimize the included angle between the exhaust cam shaft 6 and the intake cam shaft 7, thereby minimizing the volume in the combustion chamber. Further, it is possible to insert or remove the cylinder head mounting bolts 3, 3 from the apertures 10*a*, 10*a* of the cam shaft holding members 10, 10 while the exhaust cam shaft 6 and the intake cam shaft 7 are held on the cylinder head 2 by the cam shaft holding members 10, 10. Therefore, the work for bolting the cylinder head 2 to the cylinder block is markedly facilitated, and it becomes very easy to remove or retighten the cylinder head mounting bolts 3, 3 for maintenance of the engine.

In the aforesaid embodiment, each of the cam shaft holding members 10, 10 is Y-shaped as viewed from above and provided with the bolting portions 10*b*, 10*b* at the inner end portion and the bolting portion 10*c* at the outer end portion. However, it is also possible to use cam shaft holding members 10, 10 having other configurations. For example, each of the cam shaft holding members 10, 10 may have an X-shaped configuration as viewed from above and be provided with two bolting portions at the inner end portion and two bolting portions at the outer end portion. Or, the inner end portion of each of the cam shaft holding members 10, 10 may be V-shaped as viewed from above and provided with two bolting portions, and the outer end portion thereof may be formed to a wide rectangular shape having a plurality of bolting portions.

Further, in the above-described embodiment, a plurality of the intake valves and a plurality of exhaust valves are positioned for each cylinder. However, the cam shaft holding system is not limited to this valve arrangement but can also be applied to the case where there is only one intake valve (exhaust valve) and two or more exhaust valves (intake valves) per cylinder.

I claim:

1. A cam shaft holding system for an internal combustion engine in which a plurality of valves consisting of at least one intake valve and at least one exhaust valve are positioned for each cylinder of the multicylinder engine and driven by cams secured to two cam shafts, wherein the improvement comprises:

(i) securing a cylinder head to a cylinder block by cylinder head mounting bolts positioned between adjacent cylinders, (ii) extending said cam shafts adjacent to said cylinder head mounting bolts at positions outside said cylinder head mounting bolts and in the direction of the row of said cylinders, (iii) positioning cam shaft holding members between said adjacent cylinders for rotatably supporting said cam shafts on said cylinder head, (iv) each of said cam shaft holding members extending in the direction perpendicularly intersecting the axial direction of each cam shaft and having bolting portions at its end portions, (v) at least the end portion on the cylinder head mounting bolt side of each of said cam shaft holding members for rotatably supporting said cam shafts for driving a plurality of said valves for each cylinder being provided with a single bolting portion on either side of each cylinder head mounting bolt in the axial direction of each cam shaft.

2. A cam shaft holding system as defined in claim 1 wherein each of said cam shaft holding members is provided with an aperture for avoiding interference of said cam shaft holding members with said cylinder head mounting bolts, said aperture being positioned between said bolting portions at said end portion on the cylinder head mounting bolt side of each of said cam shaft holding members and extending at least above each of said cylinder head mounting bolts.

3. A cam shaft holding system as defined in claim 2 wherein said aperture is U-shaped and each of said cam shaft holding members is Y-shaped as viewed from above.

4. A cam shaft holding system as defined in claim 1 wherein a purality of said valves are directly driven by said cams.

5. A cam shaft holding system as defined in claim 1 wherein said cam shaft holding members are directly bolted to said cylinder head at said bolting portions.

* * * * *